US008857494B2

(12) United States Patent
Kirby et al.

(10) Patent No.: US 8,857,494 B2
(45) Date of Patent: Oct. 14, 2014

(54) WINDOW TREATMENT HAVING AN ADJUSTABLE BOTTOM BAR

(75) Inventors: David A. Kirby, Zionsville, PA (US); James J. Wilson, Nazareth, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 13/525,928

(22) Filed: Jun. 18, 2012

(65) Prior Publication Data

US 2013/0333849 A1 Dec. 19, 2013

(51) Int. Cl.
*E06B 3/48* (2006.01)

(52) U.S. Cl.
USPC ..... 160/84.04; 160/173 R; 160/178.1 R

(58) Field of Classification Search
USPC ..... 160/168.1 R, 173 R, 178.1 R, 84.04, 160/84.05
See application file for complete search history.

(56) References Cited

U.S. PATENT DOCUMENTS

| | | | | |
|---|---|---|---|---|
| 3,327,765 | A | 6/1967 | Strahm et al. | |
| 6,059,004 | A * | 5/2000 | Oskam | 160/84.04 |
| 6,119,757 | A * | 9/2000 | Judkins et al. | 160/178.1 R |
| 6,302,183 | B1 * | 10/2001 | Judkins et al. | 160/178.1 R |
| 6,550,522 | B1 * | 4/2003 | Lennon et al. | 160/168.1 R |
| 6,752,195 | B1 * | 6/2004 | Chou | 160/178.1 R |
| 6,792,997 | B2 * | 9/2004 | Damiano | 160/178.1 R |
| 7,096,917 | B2 * | 8/2006 | Ciuca et al. | 160/170 |
| 7,178,576 | B2 * | 2/2007 | Nien et al. | 160/168.1 R |
| 7,766,068 | B2 * | 8/2010 | Andersen | 160/173 R |
| 2003/0192653 | A1 * | 10/2003 | Nien | 160/168.1 R |
| 2004/0188038 | A1 * | 9/2004 | Nien | 160/168.1 R |
| 2005/0087310 | A1 * | 4/2005 | Nien et al. | 160/168.1 R |
| 2006/0011310 | A1 * | 1/2006 | Chou | 160/178.1 R |
| 2006/0278345 | A1 * | 12/2006 | Huang | 160/84.04 |
| 2007/0068636 | A1 * | 3/2007 | Yu et al. | 160/168.1 R |
| 2012/0261079 | A1 * | 10/2012 | Chambers et al. | 160/6 |
| 2012/0312486 | A1 | 12/2012 | Spray | |
| 2013/0153162 | A1 * | 6/2013 | Blair et al. | 160/310 |

FOREIGN PATENT DOCUMENTS

CA 2779134 A1 12/2012

* cited by examiner

*Primary Examiner* — Katherine Mitchell
*Assistant Examiner* — Scott Denion
(74) *Attorney, Agent, or Firm* — Condo Roccia Koptiw LLP

(57) ABSTRACT

A window treatment may include one or more lift cord adjustment mechanisms for leveling of a bottom bar of the window treatment. The mechanisms may allow for fine-tuning adjustment of the levelness of the bottom bar. The mechanisms may be disposed at respective ends of the botom bar. The mechanisms may be directly accessible through the ends of the bottom bar. Each mechanism may include a pulley having a circumferential groove to receive a corresponding lift cord. A portion of the pulley may protrude relative to an exterior surface of the bottom bar. The mechanisms may be hidden from view on the sides of the bottom bar, such that the mechanisms do not detract from the appearance of the window treatment. Manual operation of a mechanism may adjust an amount of a corresponding lift cord that extends from the drive shaft to the pulley of the mechanism.

27 Claims, 5 Drawing Sheets

Fig. 3

WINDOW TREATMENT HAVING AN ADJUSTABLE BOTTOM BAR

BACKGROUND OF THE INVENTION

1. Field of the Invention

The present invention relates to a window treatment having covering material extending from a headrail to a bottom bar, and more specifically, to a window treatment mechanisms allowing for easy leveling of the bottom bar without the use or tools or disassembling the window treatment.

2. Description of the Related Art

Window treatments typically include a flexible fabric or other means for covering a window in order to block or limit the daylight entering a space and to provide privacy. The window treatments for some covering materials, such as, cellular shades, Roman shades, and Venentian blinds, include two parallel lift cords extending from a bottom bar to spools on a drive shift around which the lift cords are adapted to wrap. The drive shaft may be rotated in a first rotational direction to wrap the lift cords around the spools and thus raise the bottom bar. The covering material collects on top of the bar as the bottom bar is raised, thus exposing the window and allowing daylight to enter the space. The drive shaft may be rotated in a second rotational direction to unwrap the lift cords from around the spools and thus lower the bottom bar.

If the amounts of the lift cords that extend from the bottom bar to the respective spools on the drive shaft are different from one another, the bottom bar may appear unlevel to an observer when viewed from the inside or the outside of the window. Accordingly, it is desirable to adjust the amount of the lift cords that extend between the spools on the drive shaft and the bottom bar to be able to level the bottom bar. However, prior art methods of leveling the bottom bar involved difficult and/or inaccurate procedures and sometimes required the bottom bar to be unassembled, which often required the use of tools. Therefore, there is a need for a simple method of leveling the bottom bar of a window treatment having two parallel lift cords.

SUMMARY OF THE INVENTION

The present invention provides a window treatment having mechanisms allowing for easy leveling of a bottom bar of the window treatment without the use of tools and without requiring any portion of the window treatment to be disassembled. The mechanisms allow for incremental adjustment of the amounts of each of two lift cords that extend from the bottom bar to a headrail of the motorized window treatment to thus provide fine-tuning adjustment of the levelness of the bottom bar. The mechanisms are hidden from view on the sides of the bottom bar, such that the mechanisms do not detract from the attractive, aesthetically pleasing appearance of the window treatment.

As described herein, an example window treatment may include: (1) a covering material having a top end and a bottom end; (2) a bottom bar coupled to the covering material at the bottom end; (3) a drive shaft located adjacent the top end of the covering material, the drive shaft operable to raise and lower the covering material; (4) a lift cord rotatably received around the drive shaft and extending to the bottom bar, such that rotation of the drive shaft in a first direction raises the covering material, and rotation of the drive shaft in a second direction lowers the covering material; and (5) a lift cord adjustment mechanism coupled to the bottom bar, the lift cord adjustment mechanism comprising a pulley having a circumferential groove. The pulley may be rotatably coupled with respect to the bottom bar, such that a portion of the pulley protrudes relative to an exterior surface of the bottom bar. The lift cord may be secured relative to the groove, such that rotation of the pulley causes the lift cord to wrap around the pulley within the groove, thereby adjusting an amount of the lift cord that extends from the drive shaft to the lift cord adjustment mechanism.

An example lift cord adjustment mechanism for a window treatment is also described herein. The window treatment may include a covering material and a lift cord that is rotatably received around a drive shaft and extends to a bottom bar of the window treatment, such that rotations of the drive shaft in first and second directions respectively raise and lower the covering material. The lift cord adjustment mechanism may include a compartment having a bump arranged on a surface of the compartment, and a pulley rotatably received in the compartment. The pulley may define a circumferential groove surrounded by two flanges, and may be arranged in the compartment such that the periphery of the flanges may be actuated by a user to rotate the pulley. At least one of the flanges may define teeth lining the circumference of the flange, and the bump may be adapted to be received between two adjacent teeth of the one of the flanges. The lift cord may be adapted to be received in the groove and wrap around the pulley, such that an amount of the lift cord that extends from the drive shaft to the lift cord adjustment mechanism may be adjusted in response to rotations of the pulley of the lift cord adjustment mechanism.

As further described herein, an example window treatment may include: (1) a covering material extending longitudinally from a top end to a bottom end; (2) a bottom bar coupled to the bottom end of the covering material, the bottom bar extending laterally across the bottom end of the covering material between two opposite bar ends; (3) a drive shaft positioned adjacent the top end of the covering material; the drive shaft operable to raise and lower the covering material; (4) a lift cord rotatably received around the drive shaft and extending to the bottom bar, such that rotation of the drive shaft in a first direction raises the covering material, and rotation of the drive shaft in a second direction lowers the covering material; and (5) a lift cord adjustment mechanism that is configured to rotate about a longitudinally extending axis, the lift cord adjustment mechanism located at one of the bar ends of the bottom bar and directly accessible through the bar end, the lift cord extending from the drive shaft to the lift cord adjustment mechanism. Manual rotation of the lift cord adjustment mechanism may adjust an amount of the lift cord that extends from the drive shaft to the lift cord adjustment mechanism.

Other features and advantages of the present invention will become apparent from the following description of the invention that refers to the accompanying drawings.

BRIEF DESCRIPTION OF THE DRAWINGS

The invention will now be described in greater detail in the following detailed description with reference to the drawings in which.

DETAILED DESCRIPTION OF THE INVENTION

Figure 1:
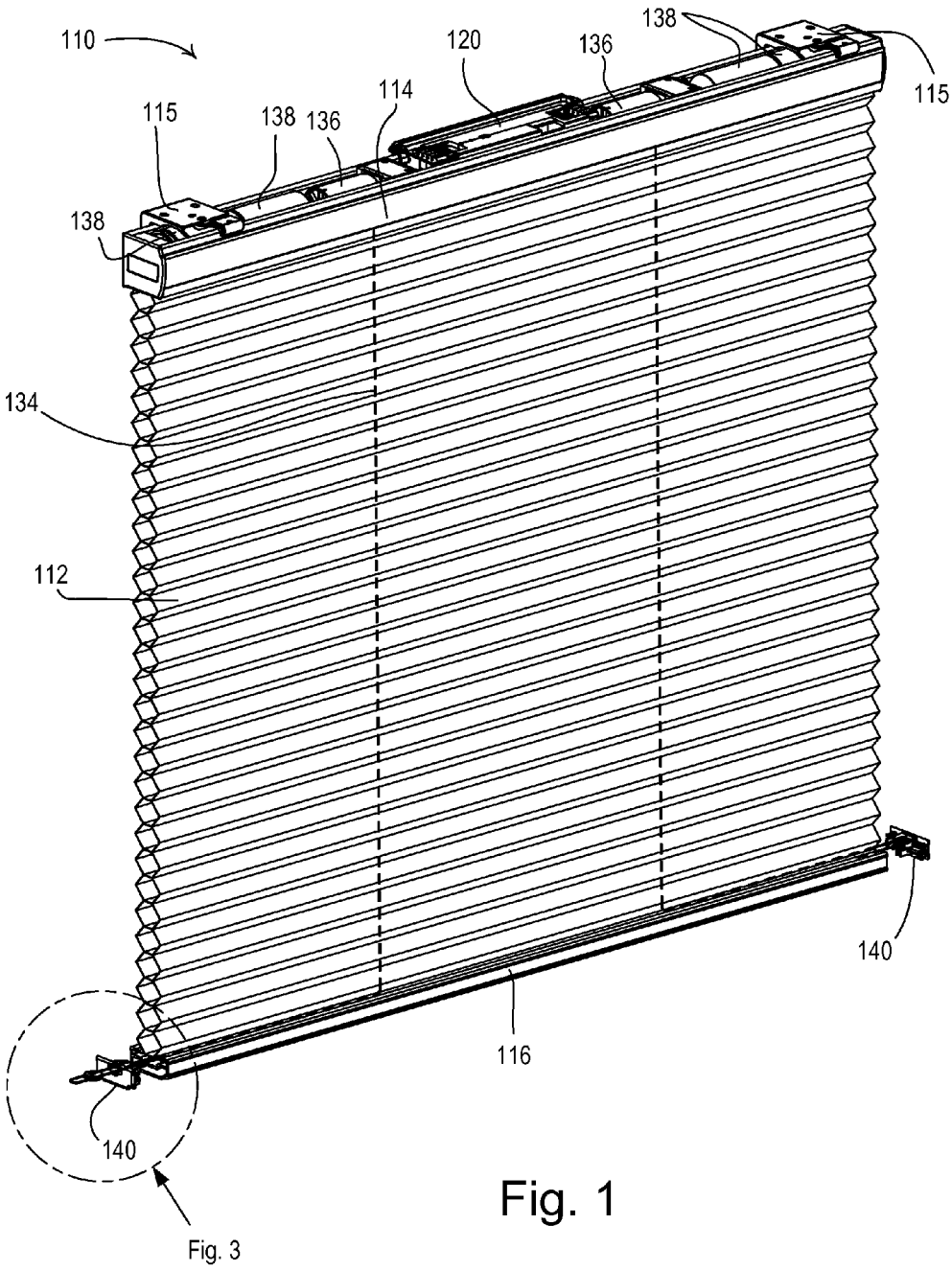
FIG. 1 is a perspective view of a battery-powered motorized window treatment according to an embodiment of the present invention.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a perspective view of a battery-powered motorized window treatment 110 according to an embodiment of the present invention. The battery-powered motorized window treatment 110 comprises a covering material (e.g., a cellular shade fabric 112) that is adapted to hang (i.e., extend longitudinally) in front of a window and may be adjusted between a fully-open position $P_{FULLY\text{-}OPEN}$ and a fully-closed position $P_{FULLY\text{-}CLOSED}$ to control the amount of daylight entering a room or space. The cellular shade fabric 112 has a top end connected to a headrail 114 and a bottom end connected to a bottom bar 116 (e.g., a weighting element), which extends laterally across the bottom end of the cellular shade fabric. The motorized window treatment 110 has mounting brackets 115 for mounting the headrail 114 to a wall or a ceiling. The motorized window treatment 110 comprises a motor drive unit 120 for raising and lowering the weighting element 116 and the cellular shade fabric 112 between the fully-open position $P_{FULLY\text{-}OPEN}$ and the fully-closed position $P_{FULLY\text{-}CLOSED}$. By controlling the amount of the window covered by the cellular shade fabric 112, the motorized window treatment 110 is able to control the amount of daylight entering the room. In addition, the battery-powered motorized window treatment 110 could alternatively comprise other types of covering materials, such as, for example, a plurality of horizontally-extending slats (i.e., a Venetian or Persian blind system), pleated blinds, a roller shade fabric, or a Roman shade fabric.

Figure 2:
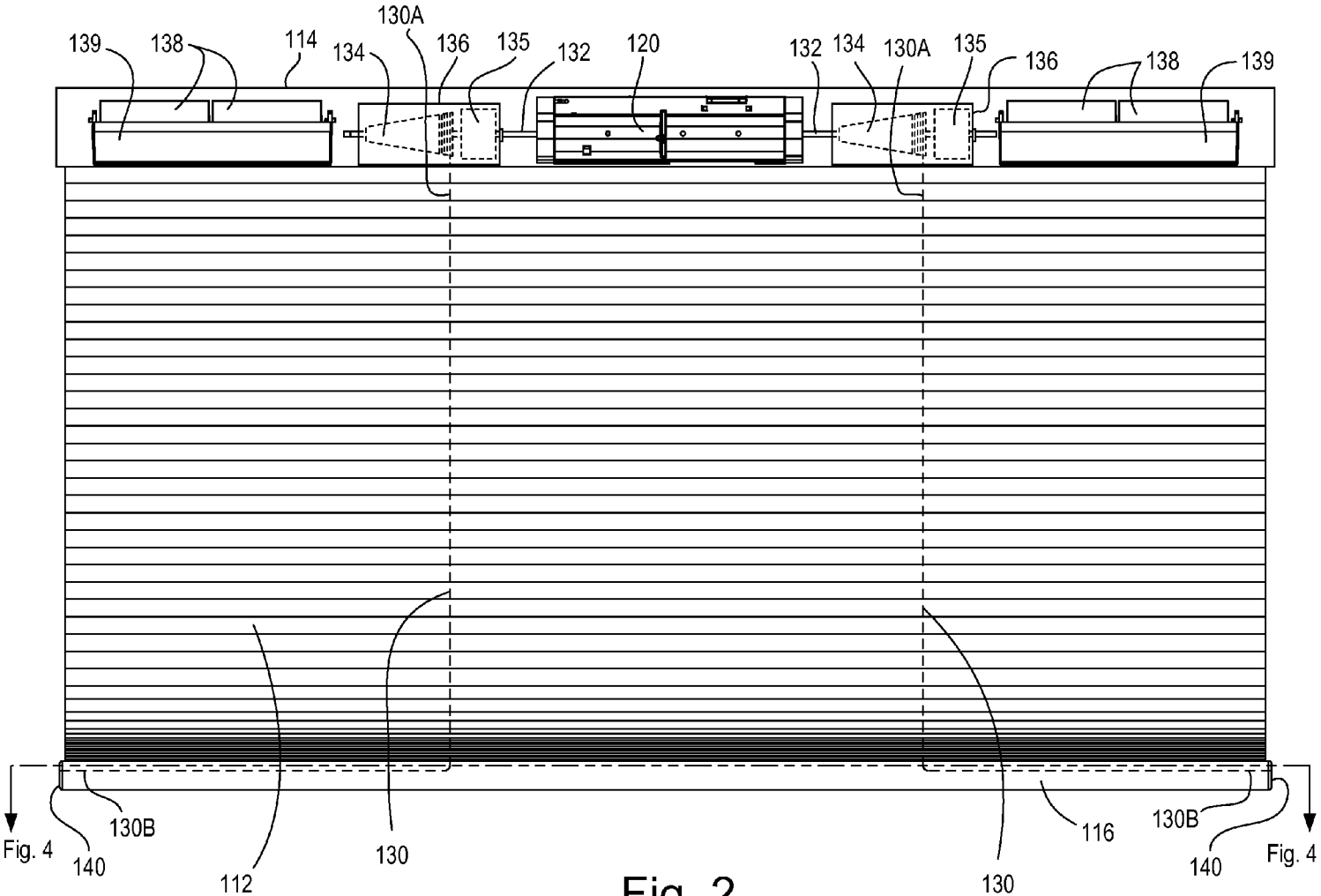
FIG. 2 is a front view of the motorized window treatment of FIG. 1.

FIG. 2 is a front view of the battery-powered motorized window treatment 110 with a front portion of the headrail 114 removed to show the motor drive unit 120, which is located in the center of the headrail. The motorized window treatment 110 comprises lift cords 130 that each comprise a first end 130A and a second end 130B opposite the first end. The lift cords 130 extend from the headrail 114 to the bottom bar 116 for allowing the motor drive unit 120 to raise and lower the bottom bar. The motor drive unit 120 includes an internal motor (not shown) coupled to drive shafts 132 that extend from the motor on each side of the motor and are each coupled to a respective lift cord spool 134. The first ends 130A of each lift cords 130 are operatively coupled to the respective drive shafts 132, such that the lift cords 130 are windingly received around the lift cord spools 134 as the drive shafts are rotated to raise the covering material 112. The second ends 130B of the lift cords 130 are fixedly attached to the weighting element 116, and the motor drive unit 120 is operable to rotate the drive shafts 132 to raise and lower the weighting element. The motorized window treatment 110 further comprises two constant-force spring assist assemblies 135, which are each coupled to the drive shafts 132 adjacent to one of the two lift cord spools 134. Each of the lift cord spools 134 and the adjacent constant-force spring assist assembly 135 are housed in a respective lift cord spool enclosure 136 as shown in FIG. 2. Alternatively, the motorized window treatment 110 could comprise a single drive shaft, which extends along the length of the headrail 114 and is coupled to both of the lift cord spools 134, and the motor drive unit 120 could be located at either end of the headrail.

The battery-powered motorized window treatment 110 also comprises a plurality of batteries 138 (e.g., four D-cell batteries), which are electrically coupled in series. The series-combination of the batteries 138 is coupled to the motor drive unit 120 for powering the motor drive unit. The batteries 138 are housed inside the headrail 114 and thus out of view of a user of the motorized window treatment 110. Specifically, the batteries 138 are mounted in two battery holders 139 located inside the headrail 114, such that there are two batteries in each battery holder as shown in FIG. 2. Since the motor drive unit 120 is located in the center of the headrail 114 and the drive shafts 132 extend out of both sides of the motor drive unit to the lift cord spools 134, there is plenty of the room for the batteries 138 to be located adjacent the opposite sides of the headrail. The batteries 138 provide the motorized window treatment 110 with a practical lifetime (e.g., approximately three years), and are typical "off-the-shelf" batteries that are easy and not expensive to replace. Alternatively, the motor drive unit 120 could comprise more batteries (e.g., six or eight) coupled in series or batteries of a different kind (e.g., AA batteries) coupled in series.

The motorized window treatment 110 further comprises lift cord adjustment mechanisms 140 located in the ends of the bottom bar 116. The lift cords 130 extend from the respective lift cord spools 134 to the respective lift cord adjustment mechanisms 140 as shown in FIG. 2. The lift cord adjustment mechanisms 140 allow for adjustment of the amount of the lift cords 130 that extend from the respective lift cord spools 134 to the respective lift cord adjustment mechanisms to thus allow for adjustment of the levelness of the bottom bar 116 (when the shade fabric 112 and the bottom bar are stationary).

Figure 3:
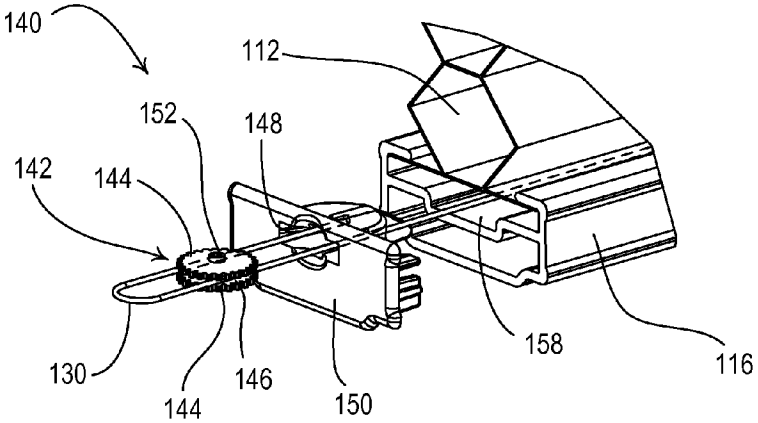
FIG. 3 is an enlarged exploded perspective view of one end of a bottom bar of the motorized window treatment of FIG. 1 showing a lift cord adjustment mechanism.
Figure 4:
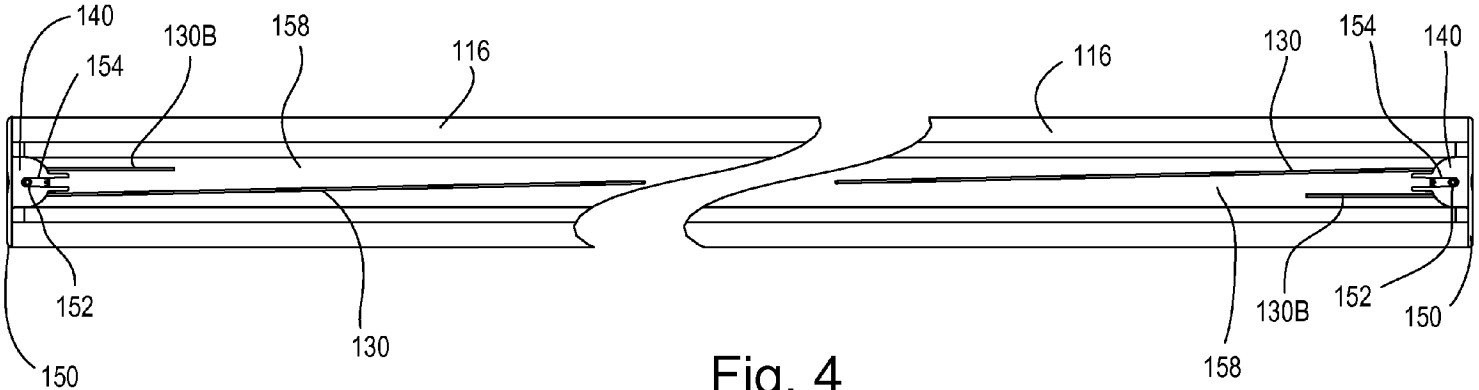
FIG. 4 is a top cross-sectional view of the bottom bar of the motorized window treatment of FIG. 1.
Figure 5:
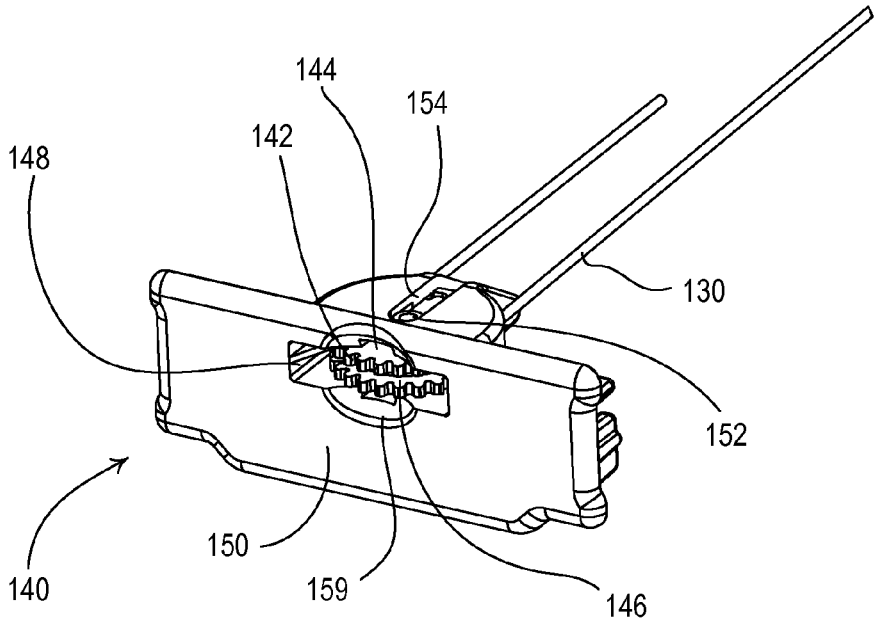
FIG. 5 is a front perspective view of the lift cord adjustment mechanism of FIG. 3.
Figure 6:
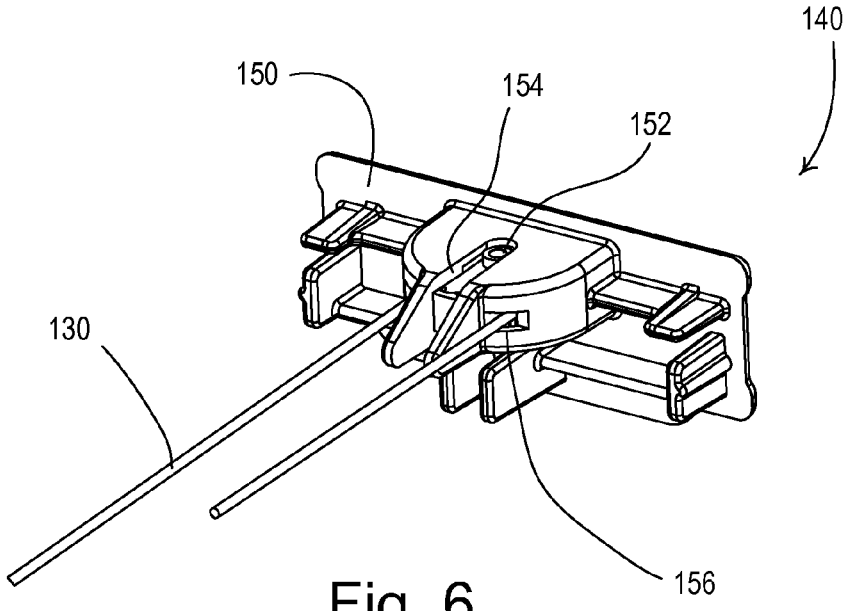
FIG. 6 is a rear perspective view of the lift cord adjustment mechanism of FIG. 3.

FIG. 3 is an enlarged exploded perspective view of one end of the bottom bar 116 showing one of the lift cord adjustment mechanisms 140 in greater detail. FIG. 4 is a top cross-sectional view of the bottom bar 116 showing the lift cords 130 and the lift cord adjustment mechanisms 140. FIGS. 5 and 6 are front and rear perspective views, respectively, of the lift cord adjustment mechanisms 140. The lift cord adjustment mechanisms 140 each comprise a pulley 142 (i.e., a drum) having two toothed flanges 144 (i.e., ratchet portions) surrounding a circumferential groove 146. The pulley 142 is received in a compartment 148 of an endcap 150 and comprises cylindrical axle portions 152 about which the pulley is able to rotate. The axle potions 152 are received in slots 154 in the compartment, such that the pulley is rotatably coupled to the endcap 150. The pulley 142 has teeth lining the circumference of the flanges 144.

The endcap 150 is received into the end of the bottom bar 116, which includes a lift cord channel 158 for receiving the portion of the lift cord 130 that extends to the respective lift cord spool 134. The lift cord 130 extends through openings 156 in the compartment 148 of the endcap 150, and is received in the groove 146 in the pulley 142. The lift cord 130 wraps halfway around the pulley 142 once, such that the second end 130B of the lift cord extends into the lift cord channel 158 of the bottom bar 116. The second end 130B of the lift cord may be tied in a knot to prevent the second end of the lift cord from coming free of the groove 146 if the pulley 142 is rotated too much in one direction. Alternatively, the second end 130B of each lift cord 130 could be attached to the pulley 142, such that the lift cord is operable to wrap around the pulley in the groove as the pulley is rotated. A user is able to rotate the pulley 142 to adjust the amount of the respective lift cord 130 that extends from the pulley to the respective lift cord spool 134. The endcap 150 comprises a recess 159 surrounding a portion of the periphery of the flanges 144, such that the flanges may be easily actuated by the user to rotate the rotate the pulley 142.

Figure 11:
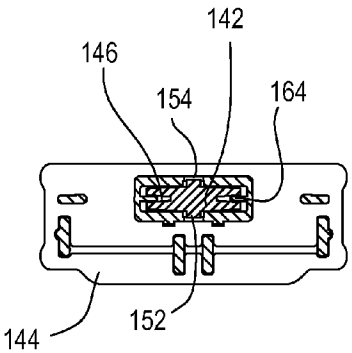
FIG. 11 is a rear cross-sectional view of the lift cord adjustment mechanism of FIG. 3.
Figure 8:
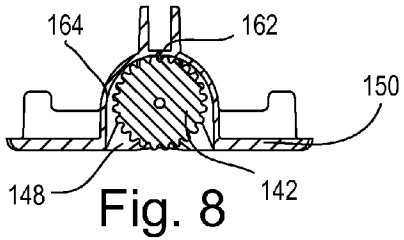
FIG. 8 is a top cross-sectional view of the lift cord adjustment mechanism of FIG. 3.
Figure 7:
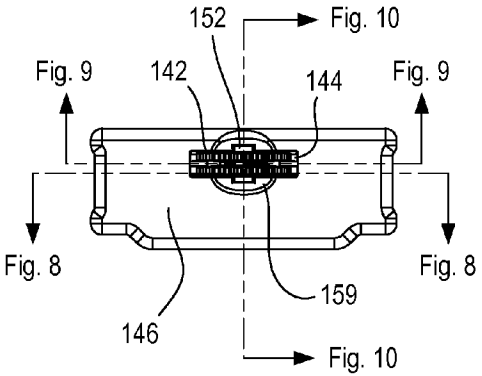
FIG. 7 is a front view of the lift cord adjustment mechanism of FIG. 3.
Figure 9:
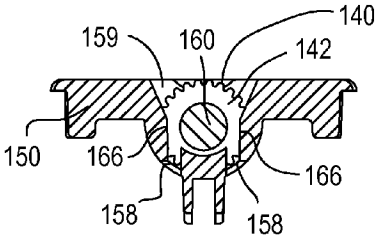
FIG. 9 is a bottom cross-sectional view of the lift cord adjustment mechanism of FIG. 3.
Figure 10:
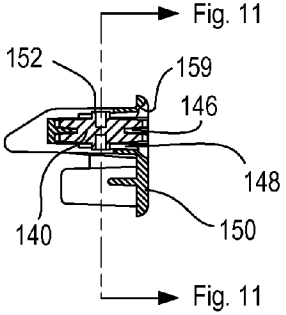
FIG. 10 is a left side cross-sectional view of the lift cord adjustment mechanism of FIG. 3.

FIG. 7 is a front view, FIG. 8 is a top cross-sectional view, FIG. 9 is a bottom cross-sectional view, FIG. 10 is a left side cross-sectional view, and FIG. 11 is a rear cross-sectional view of one of the lift cord mechanisms 140. The pulley 142 comprises a central cylindrical portion 160 (FIG. 9) located between the two flanges 144. The lift cord 130 extends through the openings 158 and around the cylindrical portion 160 of the pulley 142. The endcap 150 comprises a bump 162 that is located on a rear surface 164 of the compartment 148 and is received between two adjacent teeth of one of the flanges 144 of the pulley 142 as shown in FIG. 8. The endcap 150 also comprises wedges 166 that extend into the groove 148 of the pulley 142 when the pulley is installed in the compartment 148 as shown in FIGS. 9 and 11.

When the pulley 142 is rotated by the user, the teeth of the lower flange 144 contact the bump 162, such that the pulley 142 is forced away from the rear surface 164 of the compartment 148. The axle portions 152 of the pulley 142 are able to move through the slots 154 to allow the pulley to move away from the rear surface 164 of the compartment 148, such that the teeth of the flange 144 are decoupled from the bump 162. After one of the teeth (i.e., a tooth) moves across the bump 162 as the pulley 142 is rotated, the pulley can then come to rest with the bump located between the next two teeth of the flange 144. Accordingly, the lift cord adjustment mechanisms 140 allow for incremental adjustment of the amount of the lift cords 130 that extend from the respective lift cord spools 134 to the lift cord adjustment mechanism to thus provide fine-tuning adjustment of the levelness of the bottom bar 116.

When the motor drive unit 120 rotates the drive shafts 132 to adjust the position of the bottom bar 116, the lift cord 130 contacts the cylindrical portion 160 of the pulley 142 to pull the pulley towards the rear surface 164 of the compartment 148. Since the bump 162 is located between two of the adjacent teeth of the flanges 144, the pulley 142 does not rotate as the bottom bar 116 is raised and lowered. In addition, the lift cord 130 is pinched between the wedges 166 and the cylindrical portion 160 in the groove 146, such that the lift cord 130 is held in place and does not slip through the groove. When the pulley 142 is rotated causing the pulley to move away from the rear surface 164 of the compartment 148, the lift cord 130 is no longer pinched between the cylindrical portion 160 of the pulley and the wedges 166 in the groove 146, such that the lift cord 130 may move with the pulley as the pulley is rotated.

Rather than being located in the ends of the bottom bar 116, the lift cord mechanisms 140 could alternatively be located on the bottom of the bottom bar, for example, below the location where the lift cords 130 extend down to the bottom bar from the lift cord spools 136. In addition, the motorized window treatment 100 could comprise a single lift cord mechanism 140.

While the present invention has been described with reference to the battery-powered motorized window treatment 110 having the motor drive unit 120 powered by the batteries 138, the concepts of the present invention could be applied to window treatments having manual drive systems or having motor drive units powered by external power sources, such as a direct-current (DC) power source or an alternating-current (AC) power source.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A window treatment comprising:

a covering material having a top end and a bottom end;

a bottom bar coupled to the covering material at the bottom end, the bottom bar being elongate along a lateral direction;

a drive shaft located adjacent the top end of the covering material, the drive shaft operable to raise and lower the covering material;

a lift cord rotatably received around the drive shaft and extending to the bottom bar, such that rotation of the drive shaft in a first direction raises the covering material, and rotation of the drive shaft in a second direction lowers the covering material; and a lift cord adjustment mechanism coupled to the bottom bar, the lift cord adjustment mechanism comprising a pulley having a circumferential groove and being rotatably coupled with respect to the bottom bar, such that a portion of the pulley protrudes relative to an exterior surface of the bottom bar, wherein the lift cord is secured relative to the groove, such that rotation of the pulley causes the lift cord to wrap around the pulley within the groove, thereby adjusting an amount of the lift cord that extends from the drive shaft to the lift cord adjustment mechanism.

2. The window treatment of claim 1, wherein the lift cord adjustment mechanism comprises a compartment in which the pulley is rotatably received.

3. The window treatment of claim 2, wherein the pulley comprises two flanges surrounding the groove, the pulley being arranged in the compartment such that a periphery of the flanges may be actuated by a user to thereby rotate the pulley.

4. The window treatment of claim 3, wherein at least one of the flanges has teeth lining the circumference of the flange, the lift cord adjustment mechanism comprising a bump arranged on a surface of the compartment, the bump adapted to be received between two adjacent teeth of the one of the flanges.

5. The window treatment of claim 4, wherein the pulley comprises axles about which the pulley rotates, the axles received in slots in the compartment, such that when the pulley is rotated, the pulley moves away from the surface of the compartment and the teeth of the flanges are decoupled from the bump.

6. The window treatment of claim 5, wherein the lift cord adjustment mechanism comprises a wedge received in the groove of the pulley when the pulley is received in the compartment.

7. The window treatment of claim 6, wherein when the drive shaft rotates to raise the covering material, the lift cord is pinched between the wedge and the pulley, such that the lift cord is held in place.

8. The window treatment of claim 1, wherein the lift cord comprises a first end and a second end opposite the first end, the first end operatively coupled to the drive shaft, such that the lift cord is operable to wind around the drive shaft as the drive shaft is rotated to raise the covering material.

9. The window treatment of claim 8, wherein the lift cord wraps halfway around the pulley once and the second end of the lift cord extends into the bottom bar.

10. The window treatment of claim 8, wherein the second end of the lift cord is attached to the pulley such that the lift cord is operable to wrap around the pulley in the groove as the pulley is rotated.

11. The window treatment of claim 1, wherein rotation of the pulley of the lift cord adjustment mechanism by a user, adjusts the amount of the lift cord that extends from the drive shaft to the lift cord adjustment mechanism, so as to level the bottom bar of the window treatment.

12. The window treatment of claim 11, wherein the bottom bar of the window treatment is configured to be leveled while the drive shaft is stationary.

13. The window treatment of claim 1, further comprising: a second lift cord rotatably received around the drive shaft and extending to the bottom bar parallel to the other lift cord; and a second lift cord adjustment mechanism located at the other bar end of the bottom bar, the second lift cord mechanism comprising a second pulley having a circumferential groove and rotatably coupled with respect to the bottom bar; wherein the second lift cord extends from the drive shaft to the groove and wraps around the second pulley in the groove, such that the amount of the second lift cord that extends from the drive shaft to the second lift cord adjustment mechanism may be adjusted in response to rotations of the second pulley of the second lift cord adjustment mechanism.

14. The window treatment of claim 1, wherein the lift cord mechanism is located at one of the bar ends of the bottom bar.

15. The window treatment of claim 1, further comprising: a motor drive unit coupled to the drive shaft for rotating the drive shaft to raise and lower the covering material.

16. The window treatment of claim 1, wherein the covering material comprises one of a cellular shade fabric, a Roman shade fabric, and Venetian blind slats.

17. A window treatment comprising:

a covering material extending longitudinally from a top end to a bottom end;

a bottom bar coupled to the bottom end of the covering material, the bottom bar extending laterally across the bottom end of the covering material between two opposite bar ends;

a drive shaft positioned adjacent the top end of the covering material, the drive shaft operable to raise and lower the covering material;

a lift cord rotatably received around the drive shaft and extending to the bottom bar, such that rotation of the drive shaft in a first direction raises the covering material, and rotation of the drive shaft in a second direction lowers the covering material; and a lift cord adjustment mechanism that is configured to rotate about a longitudinally extending axis, the lift cord mechanism located at one of the bar ends of the bottom bar and directly accessible through the bar end, the lift cord extending from the drive shaft to the lift cord adjustment mechanism, wherein manual rotation of the lift cord adjustment mechanism adjusts an amount of the lift cord that extends from the drive shaft to the lift cord adjustment mechanism.

18. The window treatment of claim 17, wherein the lift cord adjustment mechanism comprises a pulley having a circumferential groove and being rotatably coupled with respect to the bottom bar, the lift cord extending from the drive shaft to the groove and wrapping around the pulley in the groove, such that the amount of the lift cord that extends from the drive shaft to the lift cord adjustment mechanism may be adjusted in response to rotation of the pulley.

19. The window treatment of claim 18, wherein the lift cord adjustment mechanism comprises a compartment in which the pulley is rotatably received, the pulley comprising two flanges surrounding the groove and being arranged in the compartment such that the periphery of the flanges may be actuated by a user to rotate the pulley.

20. The window treatment of claim 19, wherein at least one of the flanges has teeth lining the circumference of the flange, the lift cord adjustment mechanism comprising a bump arranged on a surface of the compartment, the bump adapted to be received between two adjacent teeth of one of the flanges.

21. The window treatment of claim 20, wherein the pulley comprises axles about which the pulley rotates, the axles received in slots in the compartment, such that when the pulley is rotated, pulley is able to move away from the surface of the compartment and the teeth of the flanges are decoupled from the bump.

22. The window treatment of claim 21, wherein the lift cord adjustment mechanism comprises a wedge received in the groove of the pulley, the lift cord pinched between the wedge and the pulley and held in place when the drive shaft rotates to raise the covering material.

23. The window treatment of claim 18, further comprising: a second lift cord rotatably received around the drive shaft and extending to the bottom bar parallel to the other lift cord; and a second lift cord adjustment mechanism located at the other bar end of the bottom bar, the second lift cord mechanism comprising a second pulley having a circumferential groove and rotatably coupled with respect to the bottom bar; wherein the second lift cord extends from the drive shaft to the groove and wraps around the second pulley in the groove, such that the amount of the second lift cord that extends from the drive shaft to the second lift cord adjustment mechanism may be adjusted in response to rotations of the second pulley of the second lift cord adjustment mechanism.

24. The window treatment of claim 17, wherein the amount of the lift cord that extends from the drive shaft to the lift cord adjustment mechanism is adjusted to level the bottom bar of the window treatment.

25. The window treatment of claim 1, wherein (i) rotation of the pulley in a first pulley rotational direction causes the lift cord to wrap around the pulley within the groove thereby decreasing the amount of the lift cord that extends from the drive shaft to the lift cord adjustment mechanism, and (ii) rotation of the pulley in a second pulley rotational direction causes the lift cord to unwrap from the pulley thereby increasing the amount of the lift cord that extends from the drive shaft to the lift cord adjustment mechanism.

26. The window treatment of claim 1, wherein (i) the covering material is raised and lowered along a longitudinal direction that is normal to the lateral direction, and (ii) the pulley rotates about an axis that extends along the longitudinal direction.

27. The window treatment of claim 1, wherein the exterior surface is defined by a recess that extends into an end of the bottom bar along the lateral direction.

* * * * *